United States Patent [19]

Moser et al.

[11] 4,002,145

[45] Jan. 11, 1977

[54] APPARATUS FOR APPLYING AND FIXING A MAGNETIZABLE POWDER ON A CHARGED SHEET

[75] Inventors: Kurt Moser; Helmut Wegmann, both of Gerlingen; Reinhold Weigele, Korntal, all of Germany

[73] Assignee: Develop KG/Dr. Eisbein and Co., Germany

[22] Filed: Aug. 16, 1974

[21] Appl. No.: 498,235

[30] Foreign Application Priority Data

Aug. 16, 1973 Germany ..... 2341529

[52] U.S. Cl. ..... 118/661; 118/308; 222/DIG. 1

[51] Int. Cl.[2] ..... G03G 13/08

[58] Field of Search ..... 118/636, 637, 236, 308, 118/623, DIG. 24, 621; 117/17.5, 93.4; 222/DIG. 1

[56] References Cited

UNITED STATES PATENTS

| | | | |
|---|---|---|---|
| 2,715,585 | 8/1955 | Schwartz et al. | 118/637 X |
| 2,757,635 | 8/1956 | Lipsive | 118/637 |
| 2,820,716 | 1/1958 | Harmon et al. | 118/636 |
| 3,021,817 | 2/1962 | Limberger | 118/637 |
| 3,058,405 | 10/1962 | Limberger | 118/637 |
| 3,133,834 | 5/1964 | Sowiak | 118/637 |
| 3,145,122 | 8/1964 | Streich | 118/637 |
| 3,219,014 | 11/1965 | Mott et al. | 118/637 |
| 3,526,338 | 9/1970 | Goodrich et al. | 118/637 |
| 3,547,077 | 12/1970 | Sage | 118/637 |
| 3,548,783 | 12/1970 | Knapp | 118/637 X |
| 3,703,376 | 11/1972 | Gunlach et al. | 117/17.5 |
| 3,839,992 | 10/1974 | Takahashi | 118/637 |
| 3,846,151 | 11/1974 | Roteman et al. | 118/637 |

*Primary Examiner*—Mervin Stein
*Attorney, Agent, or Firm*—Craig & Antonelli

[57] ABSTRACT

A copying machine arrangement having an apparatus for applying and fixing a magnetizable powder on a coated and electrostatically charged paper sheet to fix the image thereon. The apparatus includes conveying means for carrying the charged paper to a surface element positioned below a powder dispensing structure wherein a magnetic roller will transfer the carbon powder to the sheet surface and pressing rollers are provided for setting the powder on the paper sheet.

29 Claims, 2 Drawing Figures

APPARATUS FOR APPLYING AND FIXING A MAGNETIZABLE POWDER ON A CHARGED SHEET

Figure 1:
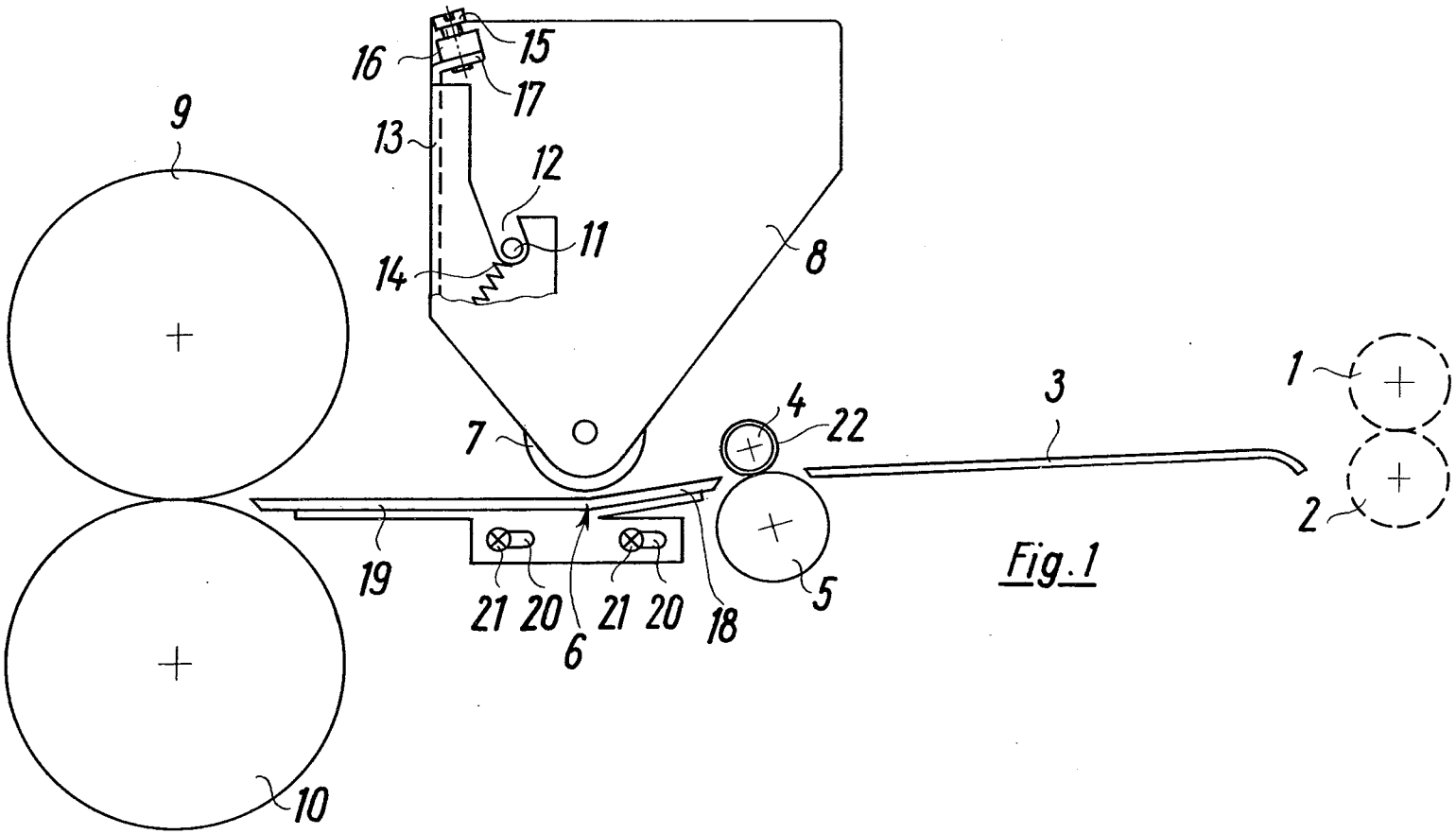

The present invention relates to an improved copying machine arrangement, and more particularly to a copying machine arrangement having apparatus associated therewith for applying and fixing a magnetizable powder to a coated and electrostatically charged paper sheet or the like. The apparatus for applying and fixing the powder includes a magnetizable roller mounted in the lower end of and projecting through a slot of a powder containing hopper. A guiding surface is positioned below and in opposed relationship to the magnetizable roller and functions to pass the paper sheet or the like after receiving the powder thereon to a pair of opposed pressing rollers whose shafts are inclined towards each other.

In order to insure that the transfer of the magnetizable powder from the magnetized roller to the coated paper will occur solely on the basis of the electrostatic charges only, a contact between the paper and the magnetized roller must be avoided and yet, at the same time, the paper and the roller must be relatively close to one another.

The aim underlying the present invention essentially resides in improving the copying machine arrangement and providing an apparatus of the type just described which will be so constructed that the paper sheet or the like is passed below the magnetized roller at a specific and selected distance.

The present invention further provides means in the form of auxiliary conveying means in front of the guiding surface whose path of travel or movement is inclined with respect to the guiding surface, which may be curved. A structure of the type made in accordance with the present invention results in the front or leading edge of the paper sheet, web, or the like, abutting safely against the guiding surface and the remainder of the sheet will be passed along the guiding surface. This provides the further advantage that sheets of a smaller size can also be safely passed through the apparatus since the distance between the driving means is diminished.

In order to insure the proper transfer of the magnetizable powder, it will be found desirable to construct the guiding surface and/or the powder container in such a manner that one or both is adjustable. Such an arrangement will make it possible to adjust the distance, even belatedly between the charge sheet passing on the guiding surface to the magnetized roller so that an adjustment to certain specific conditions may be made.

In a further development of the present invention, means are provided whereby the guiding surface includes guiding ribs which will extend in the same direction of movement of the guiding surface and also is provided with perforations which are positioned between the guiding ribs. In actul operation of the apparatus, it is virtually impossible to prevent the powder dropping off of the magnetized roller due to movement and vibrations, or the like, of the parts. By the presence of the guiding ribs and the perforations, such dropped powder cannot collect to such an extent that it can be carried along by a paper sheet and be fixed thereon.

In a still further and particularly advantageous development of the present invention, the conveying means are so constructed as to be provided with a clamping element or point in the middle thereof. The necessity for this arrangement is that due to the inclined arangement of the pressure rollers, which is necessary to compensate for any bending, there is a likelihood a paper sheet might be pulled off at an angle, especially when the paper strikes the pressing rollers in a slightly inclined direction and is seized improperly. This problem is minimized since the formation of a crease in the paper in the area of the magnetized roller is avoided by having the middle clamping element or point function in the manner of a center of rotation about which the paper sheet can straighten itself.

In order to prevent the auxiliary conveying device from improperly acting upon a conveying element or part that is present in the area where the picture transmission occurs, it is desirable to make arangements to insure that the conveying speed of the auxiliary conveying means will be slightly less than the conveying speed in the area where picture transfer is made. In this way when a paper jam ocurs in the area in front of the auxiliary conveying means, which jam may appear in the form of a light wave, the possibility of the auxiliary conveying means reacting upon another conveying element is safely avoided.

Figure 2:
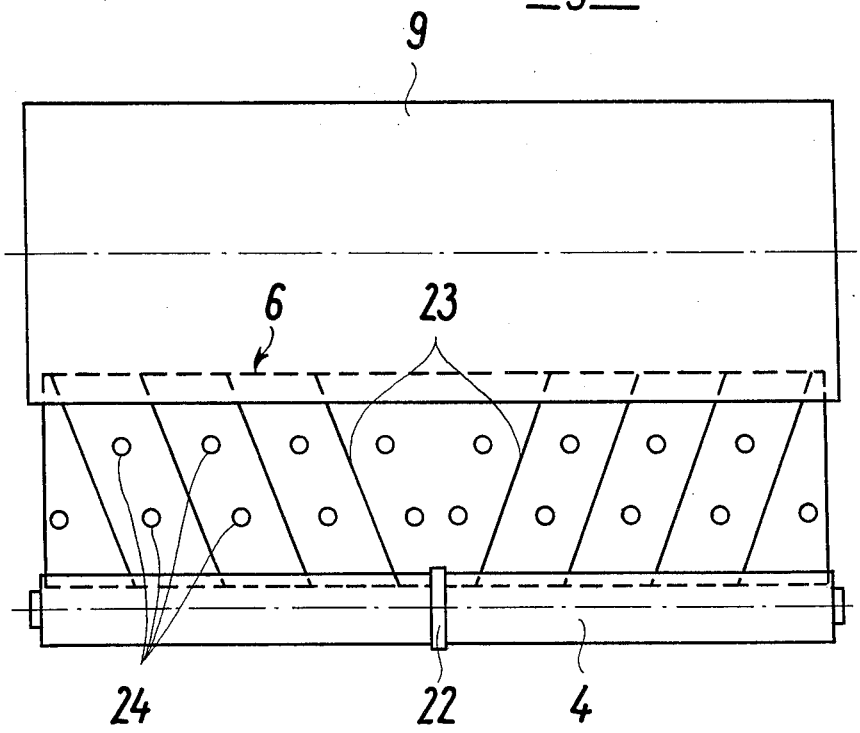

These and other objects, features, and advantages of the present invention will become more obvious from the following description when taken in connection with the accompanying drawing which shows, for purposes of illustration only, one embodiment in accordance with the present invention, and wherein:

FIG. 1 is a side view of one form of apparatus made in accordance with the present invention illustrating the path of movement of the paper and the means for applying and setting the magnetic powder; and FIG. 2 is a front view of a portion of the apparatus illustrating the guiding surface construction.

Referring now to the drawings, wherein like reference numerals are used in the two views to designate like parts, FIGS. 1 and 2 show an illustrative embodiment of apparatus made in accordance with the present invention for applying and fixing a magnetic powder to a coated and locally electrostatically charge paper, sheet, or web, and which apparatus is to be associated with a copying machine. The copying machine precedes the powder applying and fixing apparatus and is the machine where an electric charge corresponding to a scanned picture is transferred to the paper sheet or web.

As illustrated in FIG. 1, a pair of feed rollers 1 and 2 are shown in broken lines and constitute a conveying device for moving the paper sheet or web containing the image from the picture transferring section of the copying machine. The paper sheet or web is transfered by the feed rollers 1 and 2 to a baffle plate 3 for passage to the apparatus forming the basis of the present invention.

The paper sheet advanced on baffle plate 3 is seized at the forward end thereof by an auxiliary feeding means made up of a pair of rollers 4 and 5 and the paper is thereafter conveyed in a slanted or oblique plane upon a guiding surface 6, which is shown as being inclined or curved. A magnetized roller 7 is positioned above the guiding surface 6 and is moved for rotation in the bottom of a powder container 8 in a stationary aluminum tube which projects on the bottom side from a slot limited by wipers (not shown). The powder in the form of carbon powder mixed, for example, with iron dust forms a fur-like layer on the aluminum tube which rotates with the magnetized roller and the powder is partially transferred to the paper sheet that passes below due to the difference in the charges applied thereto by the varying charge patterns.

The paper sheet covered with the magnetic powder corresponding to the picture image to be transferred is thereafter conveyed to a pair of pressure rollers 9 and 10 which press the powder into the paper sheet to fix the image thereon. The shafts of the two pressing rollers 9 and 10 are inclined slightly towards each other, so that any bending that may occur as a result of the high pressing pressures can be counteracted so as to insure that a uniform pressing pressure will be distributed over the width of the paper sheet. The constructional arrangement of the pressure rollers 9, 10 may, for example, be of the type disclosed in commonly assigned U.S. Pat. application No. 498,236 (corresponding to German Pat. application P 23 41 530.7), and entitled Pressing Installation for a Copying Arrangement, filed simultaneously with this application, the disclosure of which is incorporated herein by reference to the extent necessary.

In order to achieve a proper transfer of the magnetic powder to the paper sheet passing below by the magnetized roller 7, the distance between the paper sheet or web and the magnetized roller 7 must be maintained as nearly as possible at a pre-selected value. Moreover, it will be found advisable to check this distance when servicing the apparatus and to read just if need be. For this purpose means are provided for adjusting the powder container 8, the magnetized roller 7, and the guiding surface 6 with respect to one another. As will be seen, powder container 8 is mounted by means of bolts 11 in upwardly inclined direction in slot guides 12 of a casing element 13. The position of the casing 8 is retained by means of tension springs 14 which are positioned between the casing element 13 and the bolt 11. The adjustment of the casing may be carried out by means of screws 15 which are screwed into the tapped hole of a projection of the powder casing, and abuts against a flange 17 of the casing element 13. The axial direction of the screws 15 corresponds to the direction of the slot guide 12. This directioned is determined by a gear train (not shown) and its relationship to a toothed gear which engages a gearing on the magnetized roller so that a displacement in a tangential direction will occur.

The guide surface 6, which is preferably made as a synthetic-resin molded article, is positioned in front of the magnetized roller 7 and is provided with an inlet, as seen in the conveying direction, portio 18 which, is inclined at an angle of about 15° with relation to the horizontal, and a horizontally disposed outlet portion 19 rearwardly of the inlet end 18. The jointure point between the two portions 18 and 19 is located approximately below in vertical alignment with the shaft of the magnetized roller 7. The guiding surface 6 is also provided with horizontally extending slotted guide 20 which are secured in place by fastening screws 21 and are to be adjustable in a horizontal direction. This construction makes it possible to adjust the distance between the magnetized roller 7 and the inlet portion 18 which is inclined by 15°, as well as the jointure point between the two portions 18 and 19.

The auxiliary conveying means includes a pair of rollers 4 and 5 which are so shaped that their path of movement is inclined by an angle greater than 15° with respect to the horizontal in order for the paper sheet seized by the auxiliary conveying means to be conveyed with its front edge in an inclined direction to the inlet end. This arrangement will insure that the paper sheet abuts against the guiding surface 6 and passes below the magnetized roller 7 at a set specific distance therebetween. To insure this, the shafts of the two rollers 4 and 5 are arranged in a plane that is inclined by more than 15° with respect to the vertical.

The auxiliary conveying means permits the employment of paper sheets whose length will be smaller than the distance between the conveying means from the pair of rollers 1 and 2 of the picture transfer zone and the pair of pressure rollers 9 and 10. To prevent the auxiliary conveying device from having an effect on the passage of the sheets in the area of the picture transfer zone, it is necessary to insure that the conveyance speed of the auxiliary conveying means will be slightly less than the conveyance speed of the conveying means in the zone at which the picture transfer will occur. If this differential is not present, a paper jam wherein a wave imprint is produced on the paper sheet in the area of the baffle plate 3 is produced. In order to insure the speed differential is achieved in a simple manner, a separate drive is provided for the apparatus for applying and fixing the magnetic powder. The drive is achieved by providing a drive motor (not shown) in the area beneath the baffle plate 3 which drives, by way of a chain or the like (not shown), the roller 5 of the auxiliary conveyor means, the magnetized roller 7, and the pressure roller 9 in a synchronized manner. The drive arrangment may, for example, be of the type disclosed in commonly assigned U.S. Pat. application No. 498,110 (corresponding to German Pat. application P 23 41 531. 8), and entitled Copying Machine, filed simultaneously with this application, the disclosure of which is incorporated herein by reference to the extent necessary. In this operation the magnetized roller 7 will rotate in a direction opposite to that of the conveyor means at double speed relative thereto.

When a paper sheet enters the apparatus in a slightly inclined direction, the danger exists that, due to the inclined arrangement of the pair of pressing rollers, a slanting pull-off will occur which might cause a crease in the area of the magnetized roller 7. In order to prevent this occurrence, the roller 4 of the auxiliary conveyor means is provided, at its middle, which will correspond to the middle of the paper sheet with a raised collar 22, so that the clamping effect of the auxiliary conveying means is limited to the middle area only. This collar 22 forms a point of rotation about which a paper sheet, slantingly pulled off from the pressure rollers 9 and 10, can be rotated without forming a crease in the paper.

As shown in FIG. 2, the guiding surface 6 is provided on the surface that faces th magnetized roller 7, with guide ribs 23 extending approximately in the direction of movement of the paper sheet. Two transversely extending rows of perforations 24 are also arranged between the parallel guide ribs 23. By positioning the guiding surface in this manner, any powder which drops on the surface due to vibration or the like cannot collect on the guiding surface. This will insure that at the start of the copying, powder is prevented from being carried along by the first paper sheets on the front edges and also on the bottom sides, which could cause a smudging thereof.

While we have shown and described only one embodiment in accordance with the present invention, it is understood that the same is not limited thereto but is susceptible of numerous changes and modifications as known to a person skilled in the art, and we therefore do not wish to be limited to the details shown and described herein but intend to cover all such changes and modifications as are encompassed by the scope of the appended claims.

We claim:

1. Apparatus for applying and fixing a magnetizable powder on a coated and electrostatically charged sheet of paper or the like being transported therethrough, the apparatus comprising: guide surface means for guiding the movement of the paper, said guide surface means including an inlet side and an outlet side, conveying means disposed at the inlet side of said guide surface means for conveying the sheet thereto, dispenser means positioned above said guide surface means for dispensing and applying the magnetizable powder to the paper on said guide surface means, said dispenser means including a powder container means and a magnetic roller means rotatably mounted therein and projecting therefrom in the direction of said guide surface means, said guide surface means including a planar guide surface from said magnetic roller means, said conveying means being inclined at an acute angle with respect to said planar guide surface, and means provided at the outlet side of said guide surface means for transporting the paper therefrom and setting the powder on the paper including at least one pair of pressure rollers disposed at the outlet side of said guide surface means, each of said pressure rollers being mounted on a shaft, the axis of the shafts being arranged at a mutual angle with respect to each other.

2. Apparatus according to claim 1, wherein salid conveying means includes at least a pair of opposed roller means, and said roller means being provided with a means for preventing the creasing of the paper.

3. Apparatus for applying and fixing a magnetizable powder on a coated and electrostatically charged sheet of paper or the like being transported therethrough, the apparatus comprising: guide surface means for guiding the movement of the paper, said guide surface means including an inlet side and an outlet side, conveying means disposed at said guide surface means for conveying the sheet thereto, said conveying means being obliquely oriented with respect to said guide surface means, dispenser means positioned above said guide surface means in spaced relationship thereto for dispensing and applying the magnetizable powder to the paper on said guide surface means, said dispenser means includes a powder container means and a magnetic roller means rotatably mounted therein and projecting therefrom in the direction of said guide surface means, means at the outlet side of said guide surface means for transporting the paper therefrom and setting the powder thereon including at least one pair of pressure rollers disposed at the outlet side of said guide surface means, each of said pressure rollers being mounted on a shaft, the axis of the shafts being arranged at a mutual angle to each other, and means for adjustably displaceably mounted at least one of the powder container means relative to said guide surface means and said surface relative to said conveying means and said at least one pair of pressure rollers.

4. Apparatus for applying and fixing a magnetizable powder on a coated and electrostatically charged sheet of paper or the like being transported therethrough, the apparatus comprising: guide surface means for guiding the movement of the paper, said guide surface means including an inlet side and an outlet side, conveying means disposed at the inlet side of said guide surface means for conveying the sheet thereto, said conveying means being obliquely oriented with respect to said guide surface means, and dispenser means positioned above said guide surface means in spaced relationship thereto for dispensing and applying the magnetizable powder to the paper on said guide surface means, said dispenser means includes a powder container means and a magnetic roller means rotatably mounted therein and projecting therefrom in the direction of said guide surface means, means at the outlet side of said guide surface means for transporting the paper therefrom and setting the powder on the paper including at least one pair of pressure rollers disposed at the outlet side of said guide surface means, each of said pressure rollers being mounted on a shaft, the axis of the shafts being arranged at a mutual angle with respect to each other, means for adjustably mounting said guide surface means to be displaceable relative to said conveying means and said at least one pair of pressure rollers, and means for adjustably mounting said powder container means to be displaceable relative to said guide surface means.

5. Apparatus according to claim 4, wherein means for preventing the accumulation of powder on the guide surface means are provided.

6. Apparatus for applying and fixing a magnetizable powdered on a coated and electrostatically charged sheet of paper or the like being transported therethrough, the apparatus comprising: guide surface means for guiding the movement of the paper, said guide surface means including an inlet side and an outlet side, conveying means disposed at said guide surface means for conveying the sheet thereto, said conveying means being obliquely oriented with respect to said guide surface means, dispenser means positioned above said guide surface means in spaced relationship thereto for dispensing and applying the magnetizable powder to the paper on said guide surface means, said dispenser means including a powder container means and a magnetic roller means rotatably mounted therein and projecting therefrom in the direction of said guide surface means, mens at the outlet side of said guide surface means for transporting the paper therefrom and setting the powder on the paper including least one pair of pressure rollers disposed at the outlet side of said guide surface means, each of said pressure rollers being mounted on a shaft, the axis of the shafts being arranged at a mutual angle with respect to each other, means for adjustably mounting said guide surface means relative to said conveying means and said at least one pair of pressure rollers, means for adjustably mounting said powder container means relative to said guide surface means, means for preventing the accumulation of powder on the guide surface means, said guide surface means including a guide surface, and said means for preventing the accumulation of powder on said guide surface means including plurality of ribs extending substantially in the direction of movement

7. Apparatus according to claim 6, wherein said means for preventing the accumulation of powder on the guide surface means further includes at least one perforation disposed between adjacent ribs of said plurality of ribs disposed on said guide surface means.

8. Apparatus according to claim 9, wherein said conveying means has only one clamping point disposed substantially centrally thereof.

9. Apparatus according to claim 7, wherein said conveying means includes at least a pair of opposed roller means, and wherein said roller means is provided with a means for preventing the creasing of the paper.

10. Apparatus according to claim 9, wherein said crease preventing means includes at least one annular collar means provided on at least one of said roller means, said annular collar means projecting beyond the surface of the roller means upon which it is provided.

11. Apparatus according to claim 10, wherein means are provided for driving at least one of said roller means, and wherein said annular collar means is disposed on the non-driven roll.

12. Apparatus according to claim 11, wherein said annular collar means is disposed substantially centrally of the roller means.

13. Apparatus according to claim 12, wherein said roller means are mounted on shafts, and wherein said shafts are disposed in a plane inclined in the direction of said guiding surface means.

14. Apparatus according to claim 13, wherein said means for driving at least one of said roller means includes a drive motor, and means for interconnecting said drive motor with said at least one roller means, said magnetic roller means and at least one of said pressure roller means to drive said at least one roller means at a lower drive speed than the drive speed of said at least one pressure roller means.

15. Apparatus for applying and and fixing a magnetizable powder on a coated and electrostatically charged sheet of paper or the like being transported therethrough, the apparatus comprising: guide surface means for guiding the movement of the paper, said guide surface means including an inlet side and an outlet side, conveying means disposed at said guide surface means for conveying the sheet thereto, said conveying means being obliquely oriented with respect to said guide surface means, and dispenser means positioned above said guide surface means in spaced relationship thereto for dispensing and applying the magnetizable powder to the paper on said guide surface means, said conveying means including at least a pair of opposed rollers, at least one of said rollers being provided with a means disposed substantially centrally thereof for clamping only a central area of the paper.

16. Apparatus according to claim 1, wherein means for preventing the accumulation of powder on the guide surface means are provided.

17. Apparatus according to claim 16, wherein said guide surface means includes a guide surface, said guide surface including a first substantially horizontally extending surface portion and a second surface portion inclined with respect to said first surface portion.

18. Apparatus according to claim 17, wherein said dispenser means includes a powder container means and a magnetic roller means rotatably mounted therein and projecting therefrom in the direction of said guide surface means.

19. Apparatus according to claim 18, wherein said substantially horizontally extending surface portion constitutes the output side of said guide surface means and said inclined portion constitutes the inlet side of said guide surface means, and wherein the area of transition of said first surface portion to said second surface portion is disposed in substantial vertical alignment with said magnetic roller means.

20. Apparatus according to claim 19, wherein said rollers of said conveying means are mounted on shafts disposed in a plane inclined in the direction of said guide surface means.

21. Apparatus according to claim 20, wherein the angle of inclination of said second surface portion is less than the angle of inclination of the plane in which the shafts of said rollers are disposed.

22. Apparatus according to claim 20, wherein the angle of inclination of said second surface portion is 15° with respect to a horizontally extending plane.

23. Apparatus according to claim 21, wherein a baffle plate means is disposed upstream of said conveying means for guiding the paper into said conveying means.

24. Apparatus according to claim 23, wherein means are provided for transporting the paper to said buffle plate means including at least a pair of pressure roller means.

25. Apparatus for applying and fixing a magnetizable powder on a coated and electrostatically charged sheet of paper or the like being transported therethrough, the apparatus comprising: guide surface means for guiding the movement of the paper, said guide surface means including an inlet side and an outlet side, conveying means disposed at said guide surface means for conveying the sheet thereto, said conveying means being obliquely oriented with respect to said guide surface means, and dispenser means positioned above said guide surface means in spaced relationship thereto for dispensing and applying the magnetizable powder to the paper on said guide surface means, said guide surface means including a guide surface, said guide surface including a first substantially horizontally extending surface portion and a second surface portion inclined with respect to said first surface portion, said dispenser means including a powder containing means and a magnetic roller means rotatably mounted therein and projecting therefrom in the direction of said guide surface means, said substantially horizontally extending surface portion constituting the outlet side of said guide surface menas, and said inclined portion constituting the inlet side of said guide surface means, the area of transition of said first surface portion to said second surface portion being disposed in substantial vertical alignment with said magnetic roller means, said conveying means including at least a pair of opposed roller means, said roller means being mounted on shafts disposed in a plane inclined in the direction of said guide surface means, the angle of inclination of said second surface portion being less than the angle of inclination of the plane in which the shafts of said roller means are disposed, a baffle plate means being disposed upstream of said conveying means for guiding the paper into said conveying means, means for transporting the paper to said baffle plate means including at least a pair of pressure roller means, and means for adjustably mounting said powder container means to be displaceable relative to said guide surface means.

26. Apparatus according to claim 25, wherein means are provided at the outlet side of said guide surface means for transporting the paper therefrom and setting the powder thereon.

27. Apparatus according to claim 26, wherein means are provided for adjustably mounting said guide surface means to be displaceable relatively to said conveying means and said means for transporting the paper and setting the powder thereon.

28. Apparatus for applying and fixing a magnetizable powder on a coated and electrostatically charged sheet of paper of the like being transported therethrough, the apparatus comprising: guide surface means for guiding the movement of the paper, said guide surface means including an inlet side and an outlet side, conveying means disposed at said guide surface means for conveying the sheet thereto, said conveying means being obliquely oriented with respect to said guide surface means, and dispenser means positioned above said guide surface means for dispensing and applying the magnetizable powder to the paper on said guide surface means, said conveying means including at least a pair of opposed roller means, said roller means being provided with means for preventing the creasing of the paper, said crease preventing means includes at least one annular collar means provided on at least one of said roller means, said annular collar means projecting beyond the surface of the roller means upon which it is provided.

29. Apparatus for applying and fixing a magnetizable powder on a coated and electrostatically charged sheet of paper or the like being transported therethrough the apparatus comprising: guide surface means for guiding the movement of the paper, said guide surface means including an inlet side and an outlet side, conveying means disposed at said guide surface means for conveying the sheet thereto, said conveying means being obliquely oriented with respect to said guide surface means, and dispenser means positioned above said guide surface means in spaced relationship thereto for dispensing and applying the magnetizable powder to the paper on said guide surface means, means for preventing the accumulation of powder on the guide surface means including a plurality of ribs on said guide surface means extending substantially in the direction of movement of the paper.

* * * * *